US009302824B2

(12) United States Patent
Eyal

(10) Patent No.: US 9,302,824 B2
(45) Date of Patent: Apr. 5, 2016

(54) BEVERAGE CONTAINER LID

(71) Applicant: ETS EXPRESS, INC., Oxnard, CA (US)

(72) Inventor: Sharon Eyal, Oxnard, CA (US)

(73) Assignee: ETS EXPRESS, INC., Oxnard, CA (US)

( * ) Notice: Subject to any disclaimer, the term of this patent is extended or adjusted under 35 U.S.C. 154(b) by 0 days.

(21) Appl. No.: 14/518,998

(22) Filed: Oct. 20, 2014

(65) Prior Publication Data

US 2015/0136771 A1 May 21, 2015

Related U.S. Application Data

(60) Provisional application No. 61/897,188, filed on Oct. 29, 2013.

(51) Int. Cl.

| | |
|---|---|
| ***A47G 19/22*** | (2006.01) |
| ***B65D 43/02*** | (2006.01) |
| ***B65D 47/26*** | (2006.01) |

(52) U.S. Cl.

CPC ..... *B65D 43/0202* (2013.01); *B65D 47/265* (2013.01); *B65D 2543/00046* (2013.01); *B65D 2543/00092* (2013.01); *B65D 2543/00231* (2013.01); *B65D 2543/00842* (2013.01)

(58) Field of Classification Search

CPC ..... B65D 47/265; B65D 2543/00046; B65D 2543/00231; B65D 43/0202; B65D 2543/00842; B65D 2543/00092

USPC ..... 220/253, 821, 254.4, 715; 222/557

See application file for complete search history.

(56) References Cited

U.S. PATENT DOCUMENTS

| | | | | |
|---|---|---|---|---|
| 4,171,060 | A * | 10/1979 | Howard et al. | 220/254.4 |
| 4,712,704 | A * | 12/1987 | Ramsey et al. | 220/254.4 |
| 5,294,014 | A * | 3/1994 | Wyatt et al. | 220/253 |
| 6,003,711 | A * | 12/1999 | Bilewitz | 220/253 |
| 2001/0011446 | A1 * | 8/2001 | McClean et al. | 53/452 |
| 2003/0089713 | A1 * | 5/2003 | Belt et al. | 220/253 |
| 2005/0006386 | A1 * | 1/2005 | Ronn et al. | 220/253 |
| 2006/0096983 | A1 * | 5/2006 | Patterson | 220/253 |
| 2013/0248529 | A1 * | 9/2013 | Vogel et al. | 220/212.5 |

* cited by examiner

*Primary Examiner* — Fenn Mathew

*Assistant Examiner* — James N Smalley

(74) *Attorney, Agent, or Firm* — Kleinberg & Lerner, LLP; Marvin H. Kleinberg; Marshall A. Lerner

(57) ABSTRACT

An improved beverage container lid includes a first drinking aperture near one lid edge and a second drinking aperture near the opposite lid edge. The second aperture may be sized to accommodate a straw. A rotating lid cover member in a first orientation reveals the first aperture and conceals the second aperture, in a second orientation seals both apertures and in a third orientation reveals the second aperture and conceals the first aperture.

6 Claims, 7 Drawing Sheets

BEVERAGE CONTAINER LID

BACKGROUND OF THE INVENTION

1. Field of the Invention

The present invention relates to container closures and, more particularly, an improved closure for a beverage container.

2. General Background and State of the Art

Beverage containers that are portable usually require a lid that keeps the contents from spilling. Many lids are designed with orifices that enable a user to drink from the container. Some lids merely have an opening that allows the contents to escape in a controlled fashion. Other lids may provide discrete openings for straws, either with or without an orifice for drinking or sipping.

Some lids are provided with a sliding tab that can cover or reveal a drinking orifice. Others may include a rotatable sealing cover that is threaded so that when rotated to unseal the container, a liquid flow path is created. Yet other lids have openings with removable covers. Yet other lids must be removed in order to gain access to the contents.

INVENTION SUMMARY

What is needed and what is provided by the present invention is a simple lid with apertures for drinking or for a straw and a closure that can alternatively close both apertures or selectively open one of them.

According to the present invention, there is provided a lid base with a central aperture and a drinking aperture and spaced apart from that aperture, an opening sized to fit a drinking straw. A rotatable cover member is fitted with a central post that is inserted into the central opening and can sealingly cover the drinking and straw apertures.

On the underside of the cover member, there are sealing bosses that are sized to engage the drinking and straw apertures There are additional positioning bosses. A first positioning boss is shaped to engage the straw aperture when the drinking aperture is exposed and a second positioning boss is shaped to engage the drinking aperture when the straw aperture is exposed.

In a first orientation, the cover member is rotated to seal both the drinking and straw apertures. By rotating the cover member in a first direction, the drinking aperture is exposed and the straw aperture is engaged by a positioning boss. Rotating the cover member in the opposite direction, the straw aperture is exposed and the drinking aperture is engaged by a positioning boss.

The novel features which are characteristic of the invention, both as to structure and method of operation thereof, together with further objects and advantages thereof, will be understood from the following description, considered in connection with the accompanying drawings, in which the preferred embodiment of the invention is illustrated by way of example. It is to be expressly understood, however, that the drawings are for the purpose of illustration and description only, and they are not intended as a definition of the limits of the invention.

BRIEF DESCRIPTION OF THE DRAWINGS

FIG. 5, including

FIG. 6, including FIG. 7 including

DETAILED DESCRIPTION OF THE PREFERRED EMBODIMENTS

Figure 1:
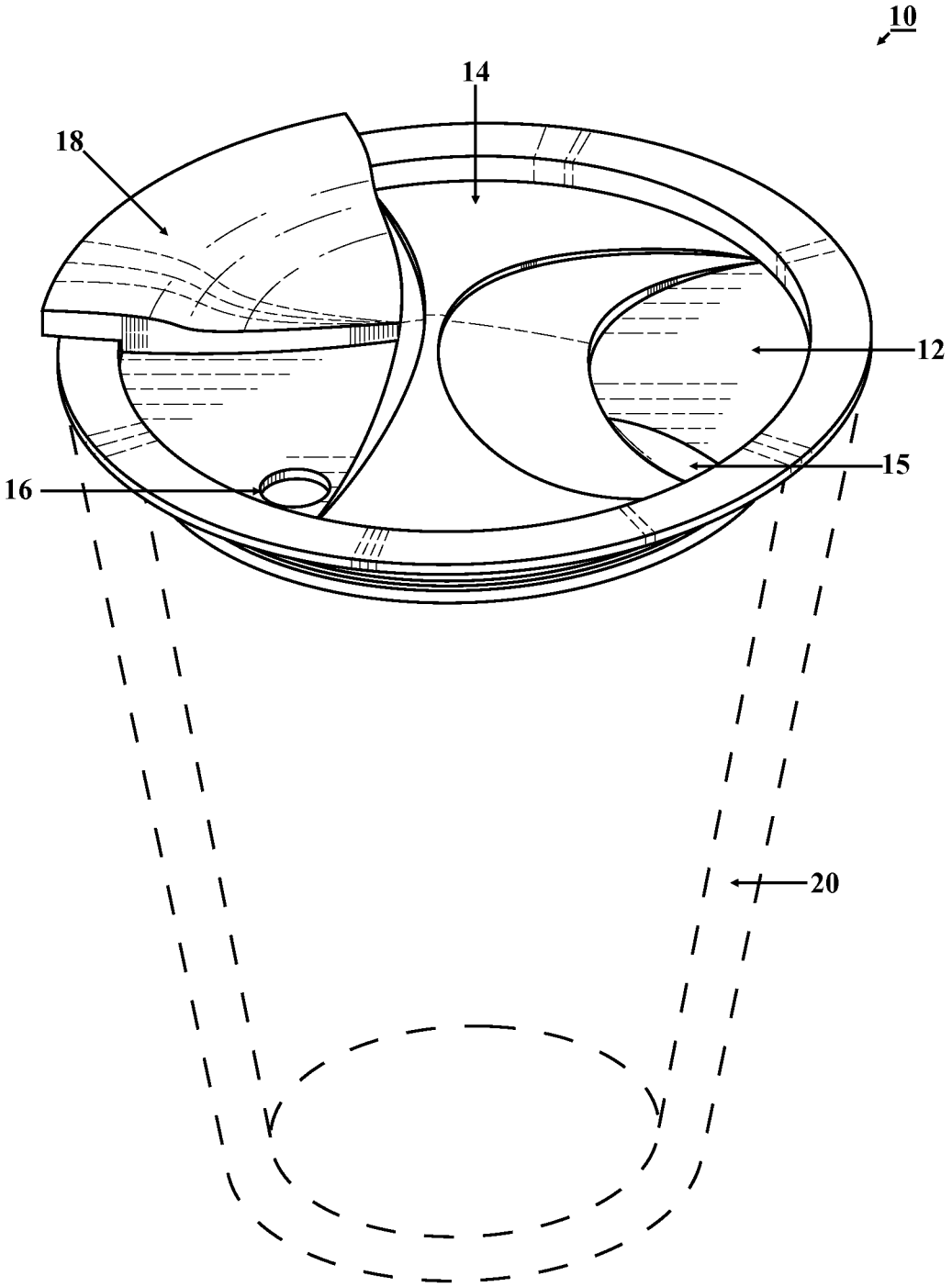
FIG. 1 is a perspective view of a first embodiment of a container lid according to the present invention.

Turning first to FIG. 1, there is shown, in perspective view, a first embodiment of a beverage container lid 10 according to the present invention. The lid 10 includes a lid base 12 and a rotatable cover member 14. A stop 15 is provided to limit rotation of the cover member 14. As shown in FIG. 1, an aperture 16 suitable for a drinking straw is in the lid base 14 and can be covered by rotating the cover member 14. A decorative tab 18 enables easy removal of the lid from the beverage container 20.

Figure 2A:
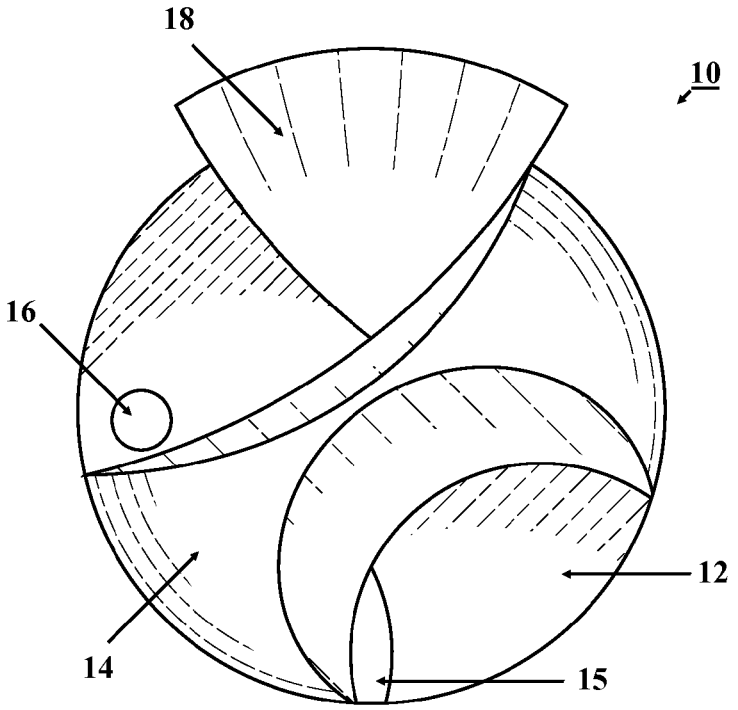
FIG. 2 including FIG. 2A
FIG. 2B is a top view of the lid of FIG. 1 with the straw aperture and the drinking aperture, respectively, exposed.
Figure 2B:
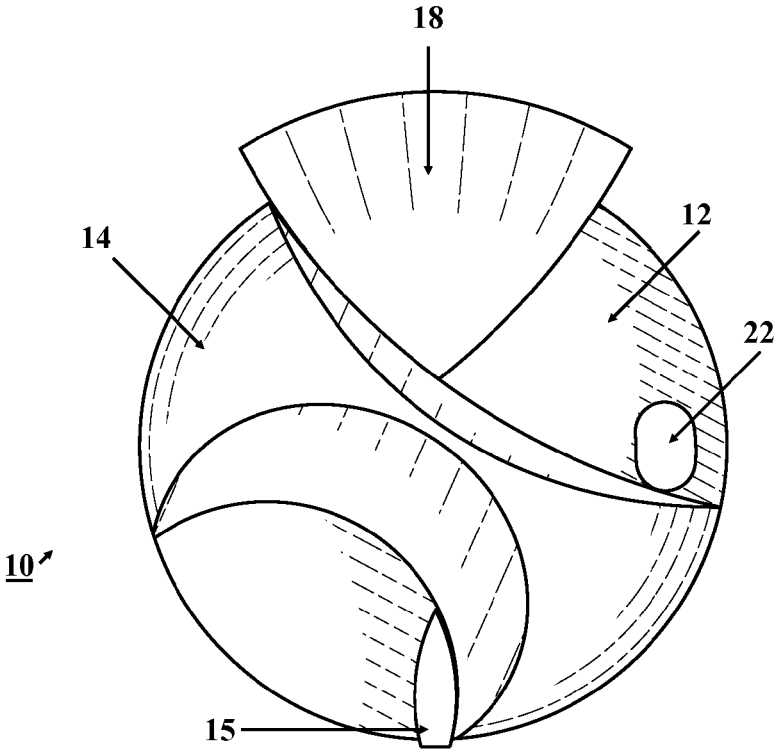
Figure 3:
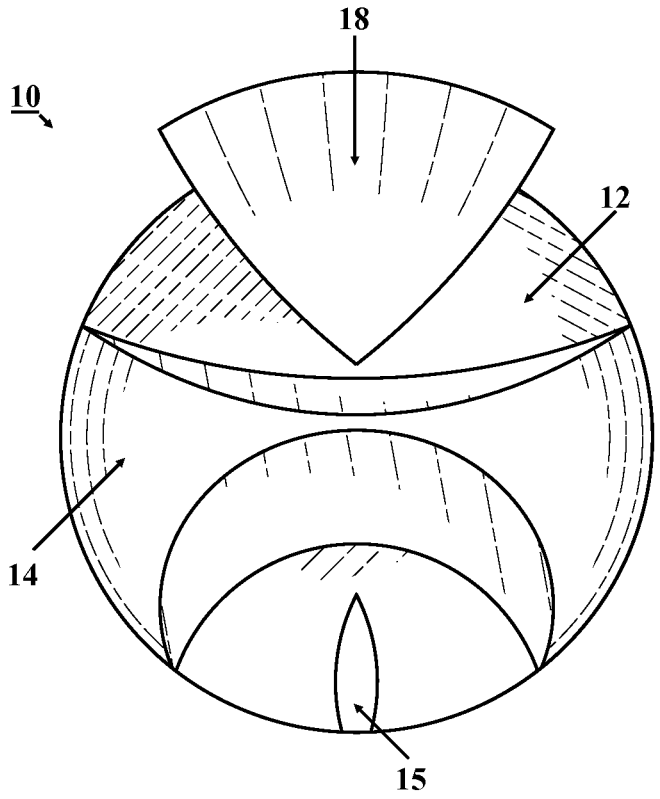
FIG. 3 is a top view of the lid of FIG. 1 with both drinking apertures concealed.

In FIGS. 2 and 3, which include FIGS. 2A and 2B. the lid is shown with cover member 14 rotated to expose the aperture 16 in FIG. 2A and, in FIG. 2B, a second aperture 22, suitable for drinking, is exposed. A third orientation is shown in FIG. 3 in which both apertures 16, 22 are blocked by the cover member 14.

Figure 4A:
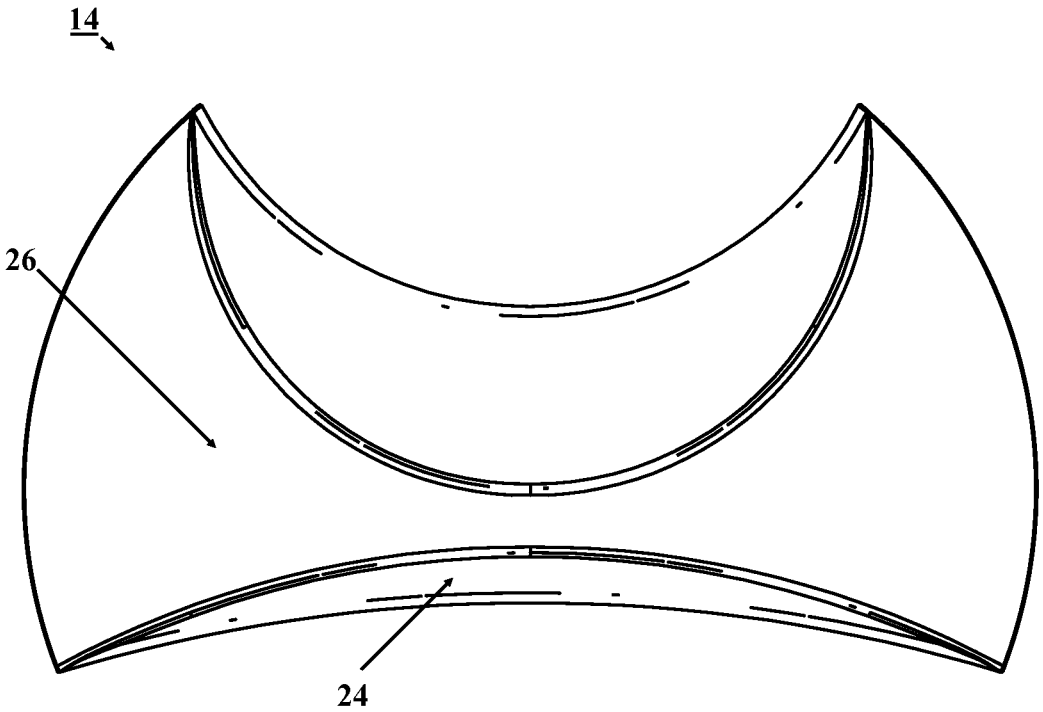
FIG. 4, including FIG. 4A and FIG. 4B area plan view and perspective view, respectively, of the cover member of the lid.
Figure 4B:
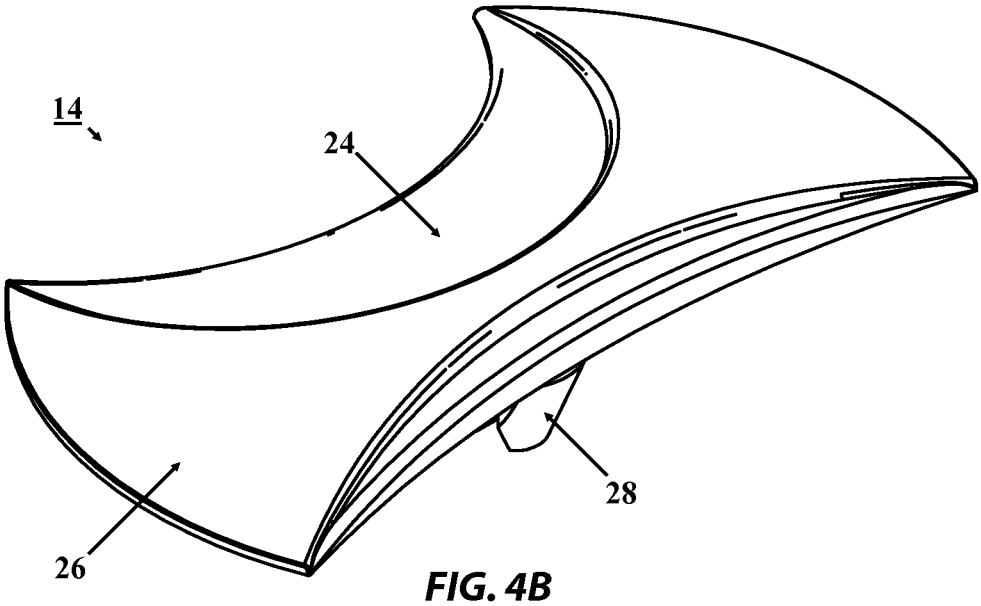

FIG. 4, which includes FIGS. 4A and 4B shows the upper surface 24 of the cover member 14 in plan view in FIG. 4A and in perspective in FIG. 4B. An arched portion 26, which rises above the surface 24 of the cover member, allows for manual rotation of the cover member 14. A post 28 extends from the underside of the cover member 14 (seen only in FIG. 4B) and is adapted to be inserted into a central aperture 29 of the lid base 12 (shown in FIG. 6) to serve as a pivot around which the cover member 14 can rotate.

Figure 5A:
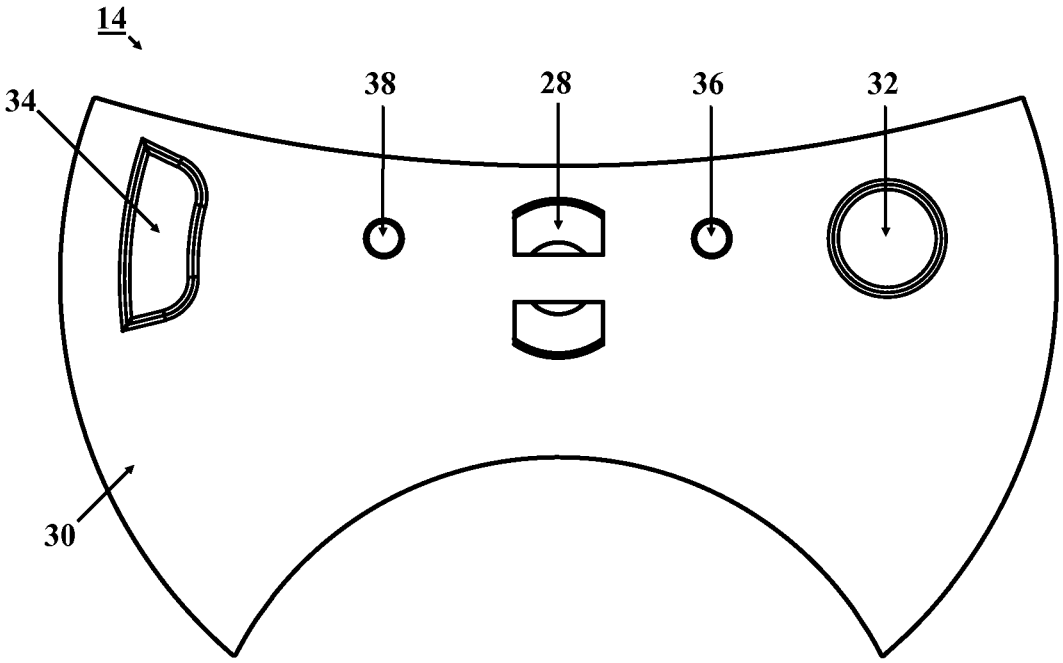
FIG. 5A and FIG. 5B are a plan view and perspective view, respectively, of the underside of the cover member of FIG. 4.
Figure 5B:
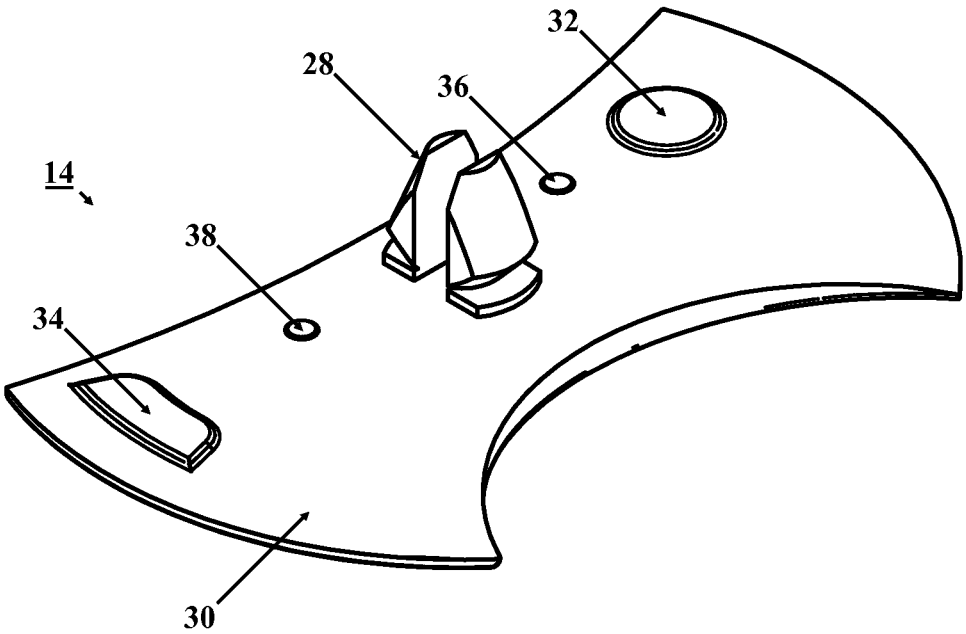

FIG. 5 which includes FIGS. 5A and 5B shows the underside 30 of the cover member 14 in plan view in FIG. 5A and in perspective in FIG. 5B. Located on the underside 30 are positioning bosses 32, 34, 36, 38 which are adapted to fit into corresponding apertures or recesses in the upper surface of the lid base 12. A first boss 32 is sized to seal the first aperture 16 and a second boss 34 is sized to seal the second aperture 22 when the cover member 14 is rotated to the intermediate, sealing configuration. Third and fourth positioning bosses 36, 38 are adapted to seat in mating depressions 40, 42 in the surface of the lid base 12 when the cover member 14 is rotated to expose one of the apertures 16, 22 and seal the other. These depressions are better seen in FIG. 6.

Figure 6A:
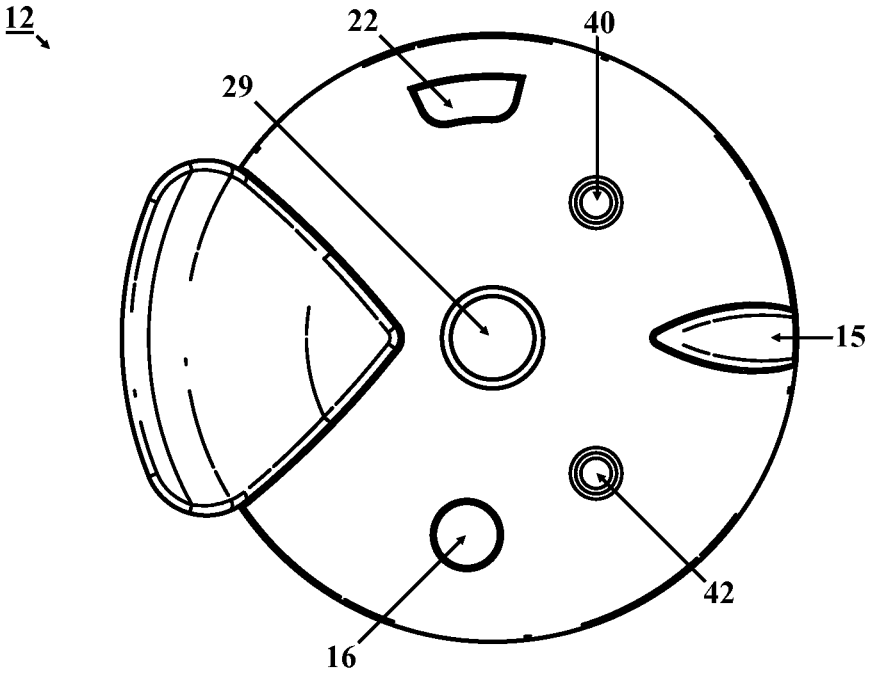
FIG. 6A and FIG. 6B are a plan view and perspective view, respectively, of the lid base.
Figure 6B:
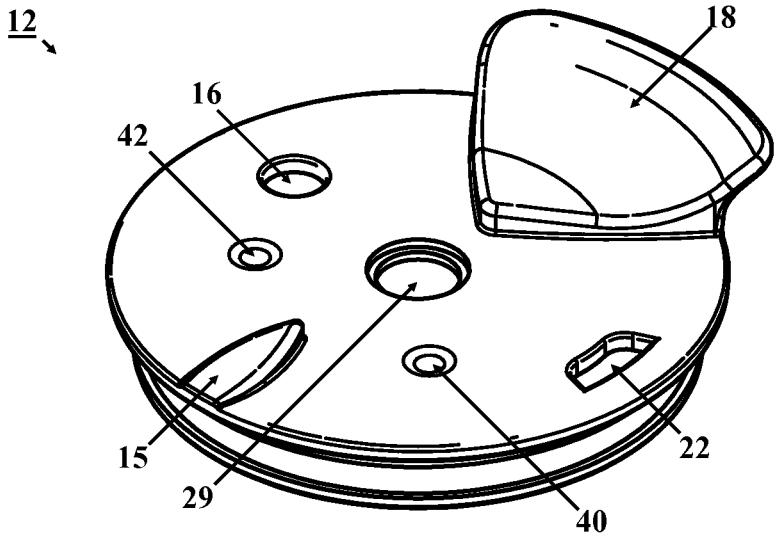

In FIG. 6 which includes FIGS. 6A and 6B, there is shown the upper surface of the lid base 12 in plan view in FIG. 6A and in perspective in FIG. 6B. In addition to the features which were visible in FIGS. 1-3, there are indexing depressions 40, 42 adjacent the stop 15 so that the rotatable cover member 14 is held in its alternative orientations which expose one or the other of the apertures 16, 22. The central aperture 29 in which the post 28 is seated can be plainly seen.

Figure 7A:
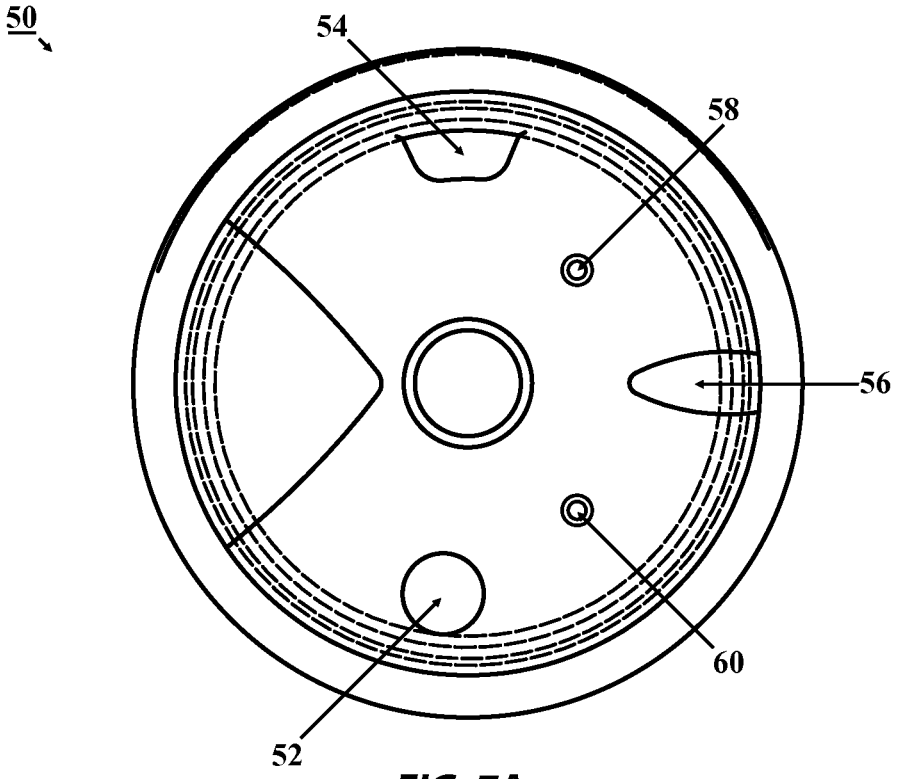
FIG. 7A and FIG. 7B are a plan view and perspective view, respectively, of a lid base according to an alternative embodiment of the invention.
Figure 7B:
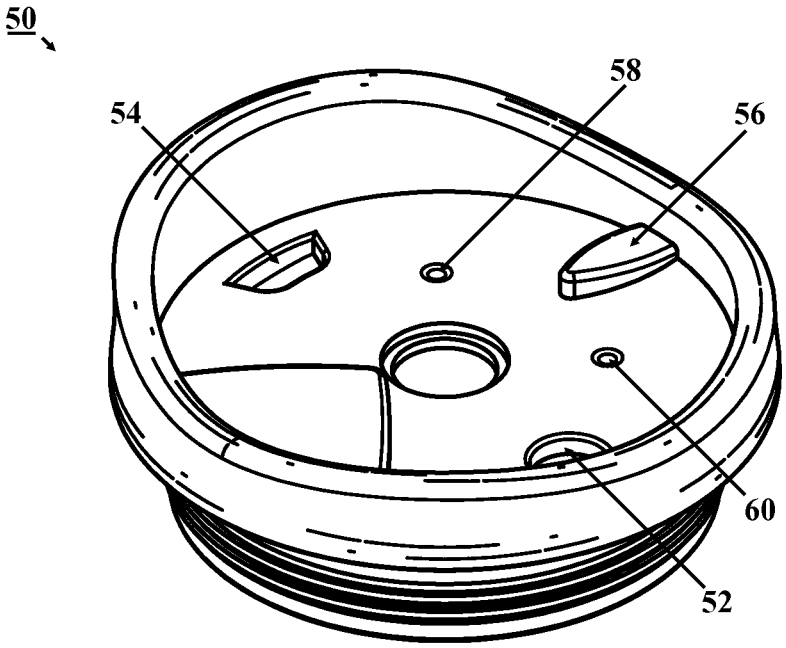

FIG. 7 which includes FIGS. 7A and 7B shows an alternative lid base 50 in plan view in FIG. 7A and in perspective in FIG. 7B. As with lid base 12, it includes a straw aperture 52 and a drinking aperture 54. A stop 56 is provided to limit rotation of the cover member (not shown) which can be substantially similar to cover member 14, described above. A pair of depressions, 58, 60 are provided to engage bosses on the cover member and, when engaged, hold the cover member in place.

In the use of the embodiment of FIG. 1, the cover member 14 can, in an intermediate orientation, cover both the straw aperture 16 and the drinking aperture 22. The first boss 32 fits into the straw aperture 16 and the second boss 34 fits into the drinking aperture 22, holding the cover member 14 in place. When the user wishes to drink through a straw, the cover member 14 is rotated to reveal the straw aperture 16 and the third boss 36 is engaged by the indexing depression 40. When the user wishes to drink from the drinking aperture 22, the fourth boss 38 is engaged by the corresponding indexing depression 42. As a result, the cover member 14 rotates among three stable orientations. It either reveals the straw aperture 16, the drinking aperture 22 or neither.

While the specification describes particular embodiments of the present invention, those of ordinary skill can devise variations of the present invention without departing from the inventive concept.

What is claimed as new is:

1. An improved beverage container lid, comprising:

a. a lid element having at least one a first aperture through which liquids can pass;

b. a rotatable covering element mounted in the center of said lid element;

c. a first boss on the underside of said covering element, sized to fill said one first aperture;

d. a first stop element on said lid element for limiting rotation of said covering element;

e. a central aperture in the center of said lid element;

f. a central post in said cover element inserted into said central aperture enabling said post to serve as the central axis of rotation of said cover element;

g. a second aperture in said lid element;

h. a third boss on the underside of said rotatable element sized to fill said second aperture; and i. a fourth boss on the underside of said cover element and second depression in said lid element adapted to receive said fourth boss when in a third orientation in which said cover element reveals said second aperture.

2. The beverage container lid of claim 1, further including a tab element at the peripheral edge of said lid member for removing said lid from a beverage container.

3. A beverage container lid comprising:

a. a lid portion;

b. a first drinking aperture in said lid portion;

c. a second drinking aperture in said lid portion;

d. a first stop element on said lid portion;

e. a second stop element on said lid portion;

f. a central aperture in said lid portion;

g. a rotatable cover member mounted in said lid portion h. a first boss on the underside of said cover member sized to fit said first drinking aperture;

i. a second boss on the underside of said cover member sized to fit said second drinking aperture;

whereby said cover member in a first orientation engages said first and second bosses in said first and second drinking apertures to seal both said drinking apertures, in a second orientation reveals said first drinking aperture and in a third orientation reveals said second drinking aperture.

4. The beverage container lid of claim 3 further including a third boss on the underside of said cover member and a first depression in said lid member whereby in said second orientation said third boss engages said first depression.

5. The beverage container lid of claim 4 further including a fourth boss on the underside of said cover member and a second depression in said lid member whereby in said third orientation said fourth boss engages said second depression.

6. The beverage container lid of claim 3 further including a tab on the edge of said lid member to facilitate removal of said lid from a beverage container.

* * * * *